US005272608A

United States Patent [19]

Engle

[11] Patent Number: 5,272,608

[45] Date of Patent: Dec. 21, 1993

[54] HOSPITAL ROOM LAMP

[75] Inventor: Joseph D. Engle, Naperville, Ill.

[73] Assignee: Alkco Manufacturing Company, Franklin Park, Ill.

[21] Appl. No.: 947,807

[22] Filed: Sep. 21, 1992

[51] Int. Cl.[5] ..... F21S 3/00

[52] U.S. Cl. ..... 362/225; 362/217; 362/240; 362/241; 362/245

[58] Field of Search ..... 362/217, 221, 222, 223, 362/240, 241, 245, 246, 225

[56] References Cited

U.S. PATENT DOCUMENTS 3,033,981 5/1962 Kushner ..... 362/222

3,557,359 1/1971 Meyer ..... 362/222

4,415,957 11/1983 Schwartz ..... 362/217

*Primary Examiner*—Carroll B. Dority

*Attorney, Agent, or Firm*—Fitzpatrick, Cella, Harper & Scinto

[57] ABSTRACT

A light fixture intended for use above a hospital bed includes a peripheral frame defining a central opening having a lamp supporting module removably mounted therein. The module includes a reflector structure and lamp supporting sockets for reflecting light upwardly and downwardly from the peripheral frame to provide both direct and indirect lighting. The module is easily removed from the frame with the light bulb and ballast connected thereto for rapid replacement.

18 Claims, 6 Drawing Sheets

FIG. 1
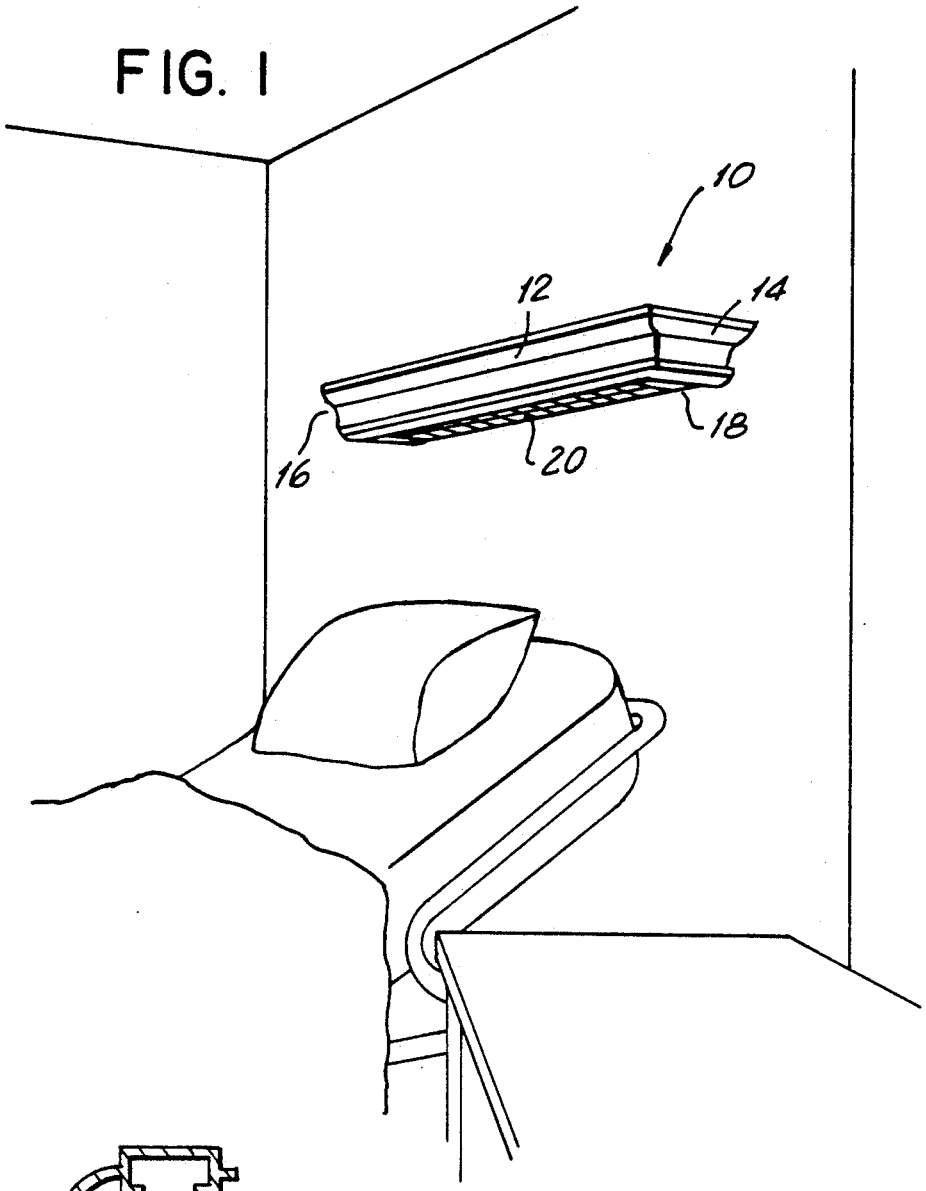
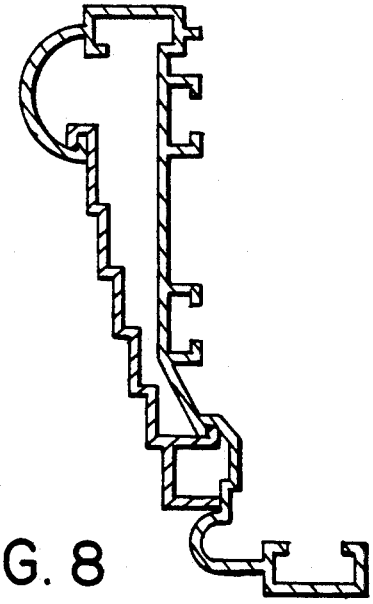
FIG. 8
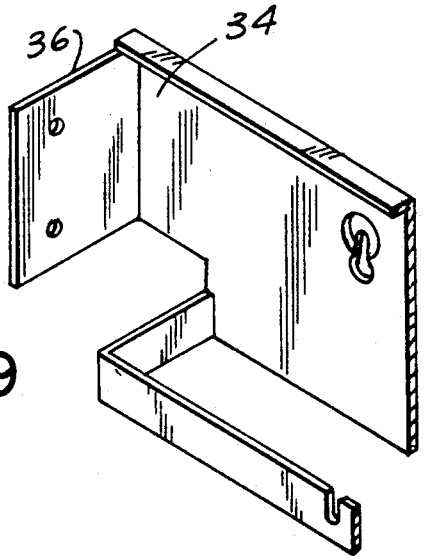
FIG. 9

HOSPITAL ROOM LAMP

The present invention relates to light fixtures, and, more particularly, to hospital room light fixtures.

In a typical hospital room a light fixture is mounted on the wall at the head of the hospital bed. The light fixture is intended to provide direct downwardly directed light in combination with or independently of indirect upwardly directed light. Such light fixtures typically utilize fluorescent lamps with a ballast. When it becomes necessary to replace the lamps or the ballast, a time-consuming process is involved which may necessitate movement of the hospital bed and/or patient. In addition to physically disturbing the patient, the process of changing the bulbs or ballast in such fixtures will take some time and require the workman to bring tools and supplies to the hospital room in order to make the repair. All of this is undesirable in terms of disturbing patient treatment and possibly contaminating the hospital room.

It is an object of the present invention to provide a hospital room light fixture which is pleasing in appearance and includes a self-contained lighting module that is easily and rapidly removed and replaced from the light fixture.

Another object of the present invention is to provide a hospital room light fixture which is relatively simple to manufacture.

Another object of the present invention is to provide a light fixture which is fabricated from a minimal number of parts.

Yet another object of the invention is to provide a light fixture, including a reflector structure, which can provide both upward and downward reflected light.

Another object of the present invention is to provide a hospital room light fixture which is relatively simple in construction and economical to manufacture.

Yet another object of the present invention is to provide a hospital room light fixture which can be readily and rapidly repaired.

In accordance with an aspect of the present invention, a hospital room light fixture is provided that includes a peripheral frame having front and back sides which define a central open area. The frame has a predetermined depth and includes upper and lower portions. A lamp supporting module is removably mounted within the central open area of the frame. The frame has an internal peripherally extending support surface along at least a portion thereof and the lamp supporting module has a mating support surface adapted to rest on the support surface of the frame when the module is placed in the central opening. Means are provided for releasably securing the module to the frame to permit rapid and convenient removal of the module.

The module includes side walls and a central elongated reflector extending therebetween. The reflector is positioned diagonally in the module and extends between the front and back sides and the upper and lower portions of the frame. In one embodiment, fluorescent lamp support sockets are mounted in the side walls of the module for mounting a pair of lamps respectively above and below the reflector so that the lighting fixture produces direct light beneath the frame and indirect light above the frame. The module also includes preformed mounting structures for securing a transformer or ballast thereto which is removed from the light fixture with the module.

The above, and other objects, features and advantages of this invention will be apparent in the following detailed description of an illustrative embodiment thereof, which is to be read in connection with the accompanying drawings wherein:

FIG. 1 is a perspective view of a hospital room wall light fixture according to the present invention;

FIG. 8 is a partial sectional view similar to FIG. 7 illustrating yet another frame structure; and FIG. 9 is a partial perspective view of one end of the rear wall of the peripheral frame of the light fixture of FIG. 1.

Figure 2:
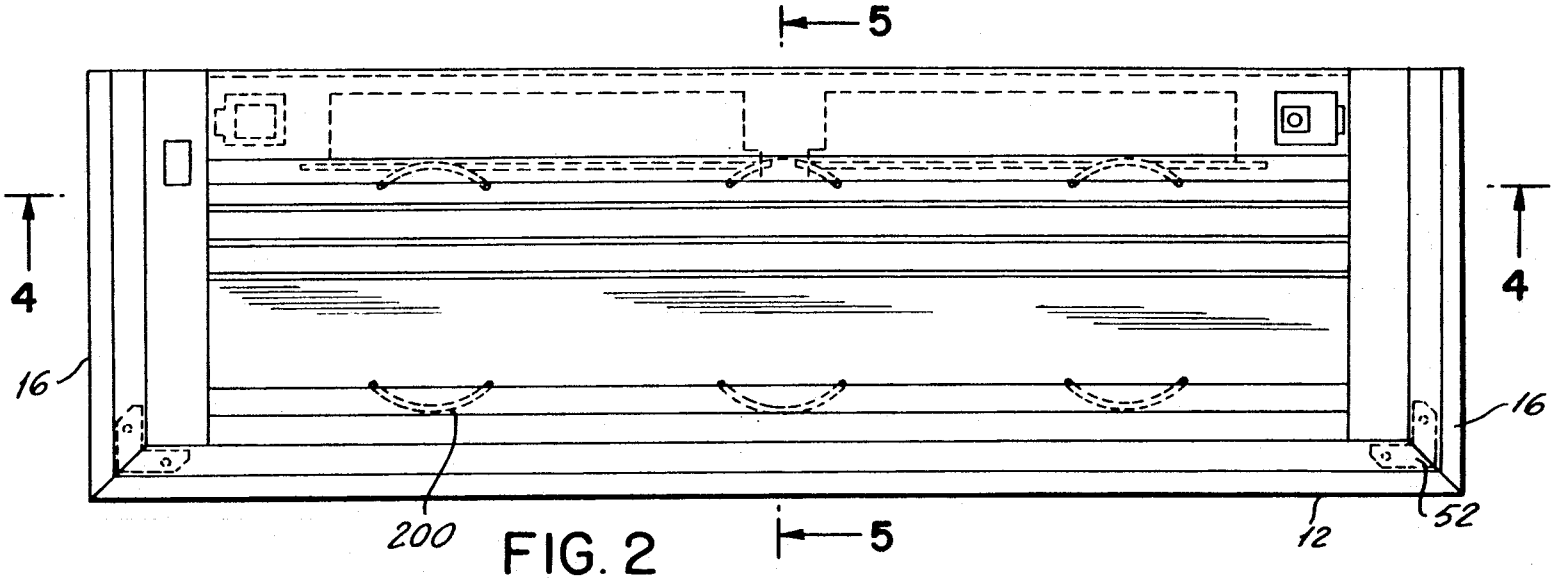
FIG. 2 is aplan view of the light fixture of FIG. 1.
Figure 3:
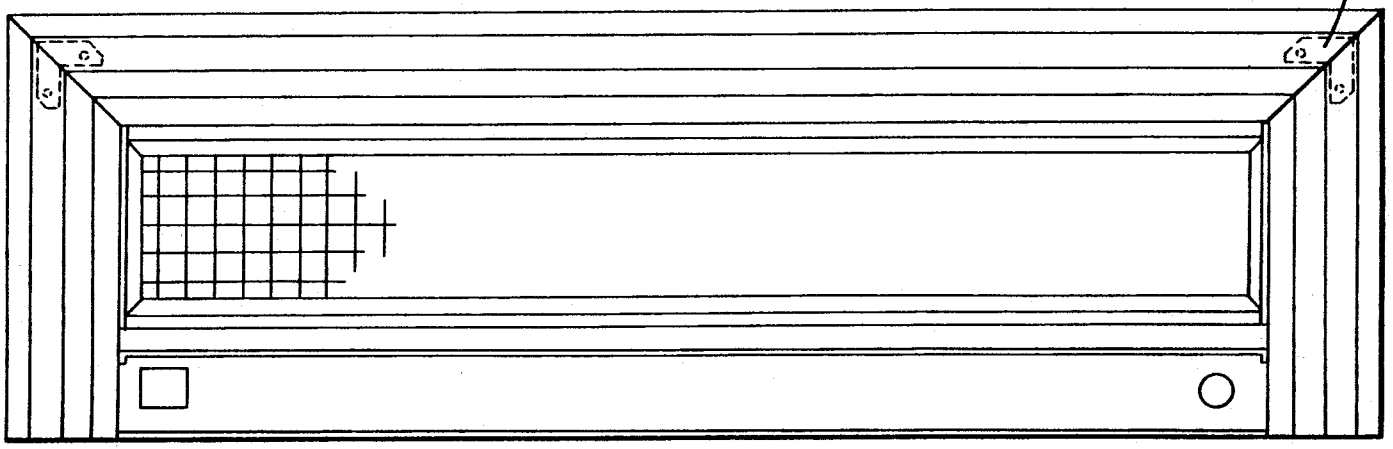
FIG. 3 is a bottom view of the light fixture of FIG. 2.

Referring now to the drawing in detail and initially to FIG. 1, a lamp fixture 10 constructed in accordance with the present invention is illustrated which is generally rectangular in shape and includes a front side 12, opposed sides 14, 16, and a rear side 18. The light fixture is formed from a peripheral frame having these four sides and defining a central opening 20 therein.

A removable lamp supporting module 22 (FIG. 5) is adapted to be received and supported within the frame 12. The module has mounted therein the lamps or light bulbs used to create illumination both directly through the open bottom 24 of the light fixture to the bed and indirectly through the open top 26 of the light fixture.

Figure 4:
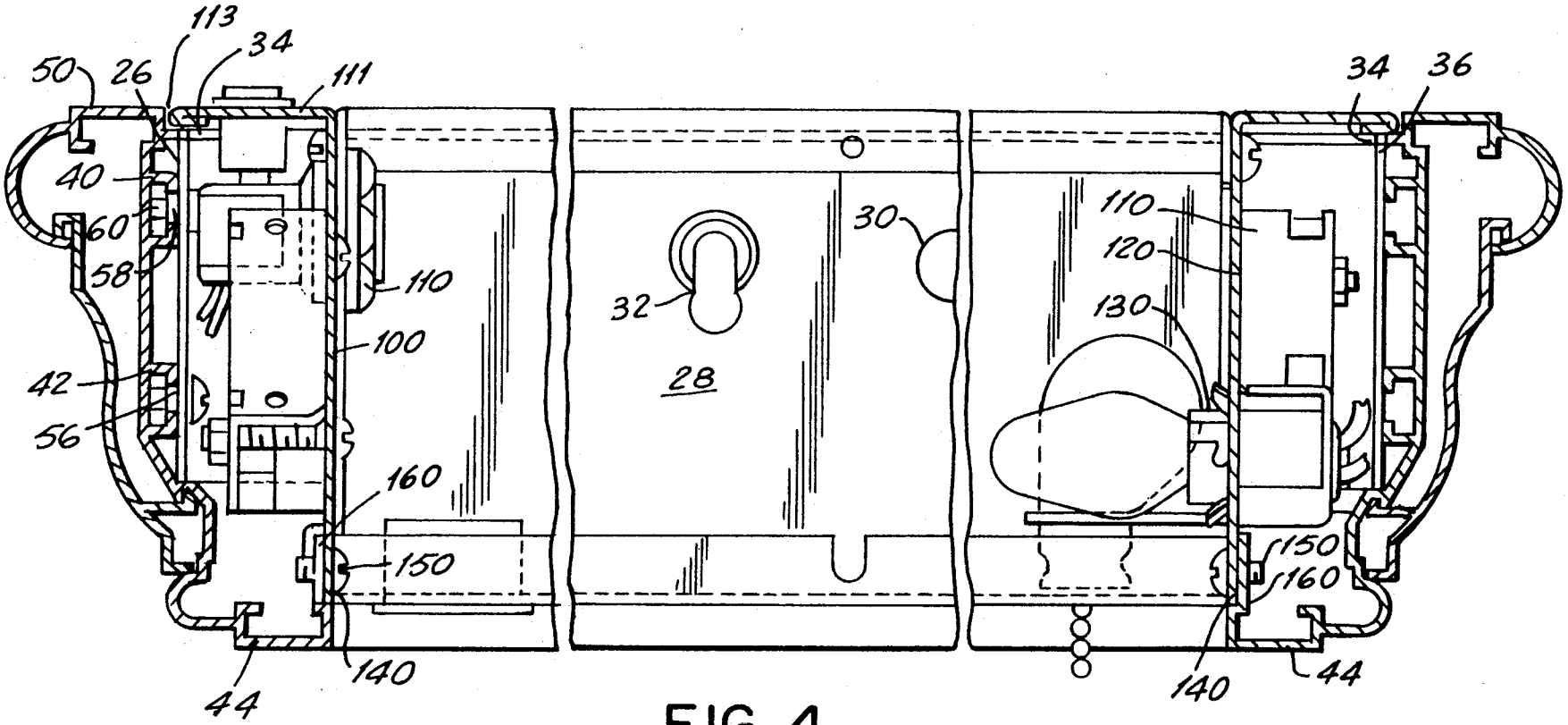
FIG. 4 is a sectional view, with parts broken away, taken along line 4—4 of FIG. 2.

The rear wall 18 of frame 12 is a generally flat metal frame member 28 which includes a central opening 30 through which electrical supply lines can pass from a wall outlet and a pair of keyhole slots 32 (only one of which is shown in FIG. 4). The keyhole slots serve to mount the rear frame member 28 on the room wall in the conventional manner by receiving the heads of the screws previously mounted in the wall.

The ends 34 of frame member 28 include outwardly projecting ears 36 which extend a short distance from the hospital room wall (say, for example, about 1 to 2 inches). The decorative frame portion of the light fixture is mounted on rear frame member 28 by means of these ears 36.

Figure 5:
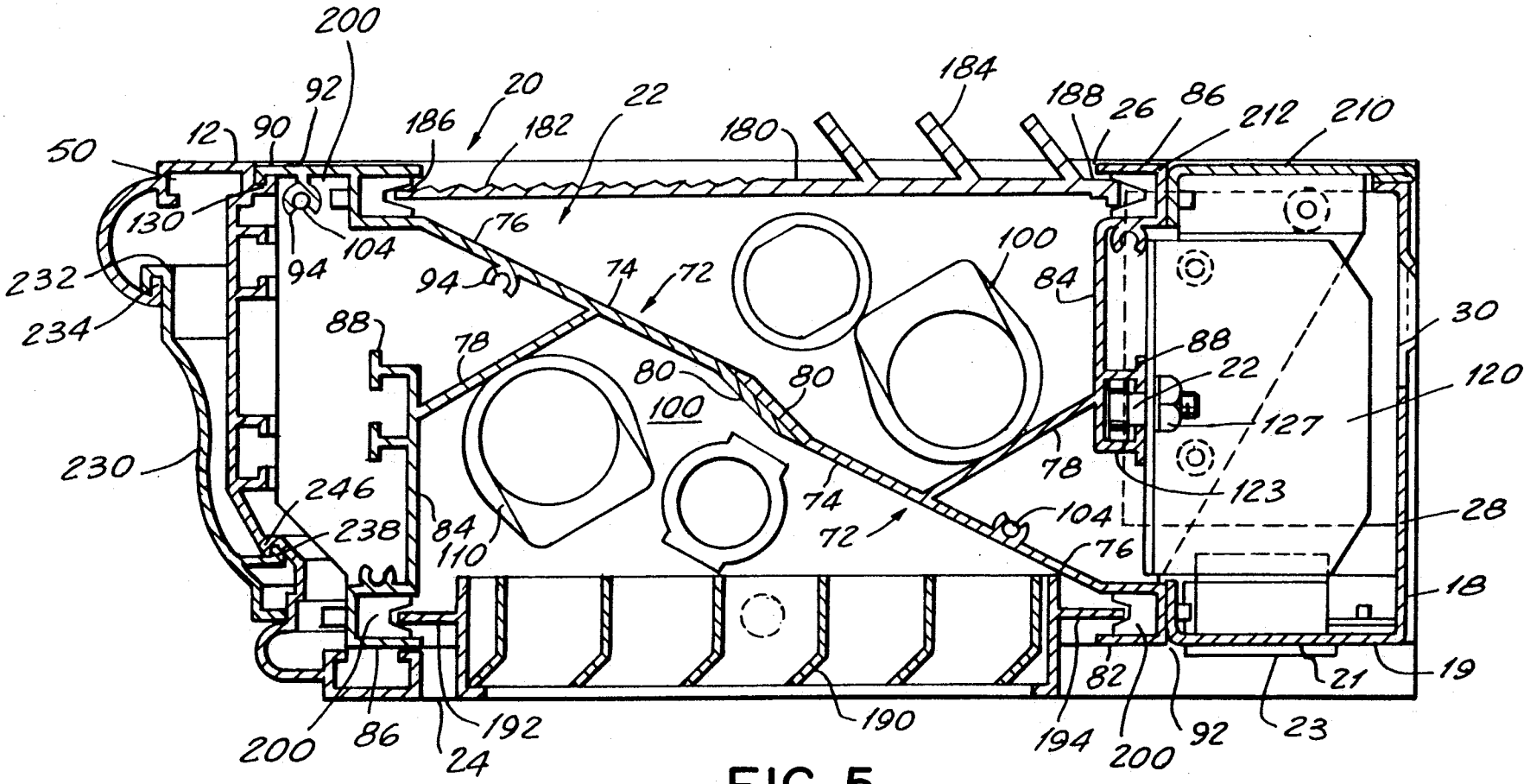
FIG. 5 is a sectional view taken along line 5—5 of FIG. 2.

The decorative peripheral frame element for the light fixture of the present invention is illustrated in cross-sectional detail in FIGS. 4 and 5. The same frame element cross-section or profile is used to form the front wall 12 as well as the side walls 14, 16 of the light fixture.

The frame is formed of an extruded aluminum profile, or the like. The exterior configuration, or face, of the profile can take a variety of different shapes, as desired, and as seen in FIGS. 4, 6, 7 and 8. But, in each case the profile has the same rear face structure and includes at least two elongated T-shaped slots 40, 42 formed therein. The embodiment of FIG. 4 includes a third elongated T-slot 44 which opens upwardly, while the slots 40, 42 open inwardly toward the central opening of the light fixture.

The ends of the front and side walls 12, 14, 16 at the front corners of the fixture are mitered at 45° angles and joined together by conventional tapped corner angles 52. In the FIG. 4 embodiment, these angles fit in the downwardly opening T-slot 50 formed at the upper end or portion of the profile. They are held in place and lock the profile sections together by conventional tap or set screws, or the like. In the FIG. 7 embodiment the profile of the frame does not have the T-slot 50 formed therein. It includes an internally extending flange 51 instead. The corner angles 52 are secured to this flange by self tapping screws, or the like, to form a rigid structure.

The rear ends of the profile sections forming side walls 14 and 16 are secured to the extensions 36 of the rear wall by bolts 56, 58 which engage mating units 59, 60 located within the T-slots 40, 42 of the side walls. Lock washers (not shown) 62 may be provided if desired. (Alternatively, the bolts may have polygonal heads trapped in the T-slots and nuts secured to their free ends on the opposite sides of extensions 36). By this construction a rigid peripheral frame element for the light fixture is provided.

The removable lamp supporting module 22 is adapted to be received in the central opening 26 defined by the decorative frame of the present invention. The module is most clearly illustrated in FIGS. 4 and 5. The module is formed of two identical Y-shaped reflector elements 72. Each reflector element includes a stem 74 and a pair of legs 76, 78, with stem 74 aligned with leg 76. The reflectors are formed of extruded aluminum or plastic and are arranged in the module so that the free ends 80 of their stems 74 overlap. Preferably, the surfaces of the reflector which face the upper opening and lower opening of the frame are coated with a light reflective material.

Legs 76, 78 of reflectors 72 have a plurality of channels formed at their free ends. In particular, leg 76 has an open channel 82 formed at its free end, which opens in the direction of its associated stem 74. Leg 78, on the other hand, has an elongated support plate 84 formed thereon which includes an open channel 86 at its free end. Channel 86 also opens in the direction of stem 74 and is parallel to and substantially the same size as channel 82. In addition, at the other end of plate 84 a T-slot 88 is formed which extends along the length of the reflectors from side to side of the module. Channels 82 include an integral extension plate 90 connected to the base of the channel at a frangible seam 92. As seen in FIG. 5, the reflector 72, which is located towards the front of the light fixture, includes the extension support plate 90, while the other reflector 72, located toward the rear of the fixture, has the plate 90 removed therefrom at frangible seam 92 before the device is assembled. By this construction of the reflector, a single component is manufactured which is used to form both halves of the entire reflector assembly. If desired, the overlapped portions 80 of stems 74 can be secured together in any convenient manner, preferably, for example, by a two-sided adhesive strip.

Each of the reflectors 72 includes a plurality of elongated C-shaped channels 94 formed therein at at least three locations, as seen in FIG. 5. These C-shaped channels serve to form a connection with the side walls of the module. The side walls of the module are thin sheet metal plates, or the like, having an appropriate number of openings of predetermined shape formed therein for mounting the light fixtures or sockets for the bulbs used in the lamp.

As seen in FIGS. 4 and 5, the module 26 includes side walls 100, 102. These side walls are connected to reflectors 72 by a plurality of screws 104 which pass through appropriate openings in the side walls and are threaded into the C-shaped channels 94. This forms a relatively rigid box-like structure defining the light module. The structure is sufficiently rigid that it is not normally required to use an adhesive between the overlapping stems, although, as noted above, such an adhesive may be used.

The end walls 100, 102 are generally L-shaped in cross-section and include short upper legs 111 which extend between the edges of the reflector and the internal surface 113 of the decorative fixture to form a decorative closure for the top of the light fixture. If desired, the rear wall 18 may have a lower inwardly extending horizontal wall portion 19 also forming a decorative trim piece and having an aperture 21 formed therein for receiving an electrical convenience outlet 23.

Figure 6:
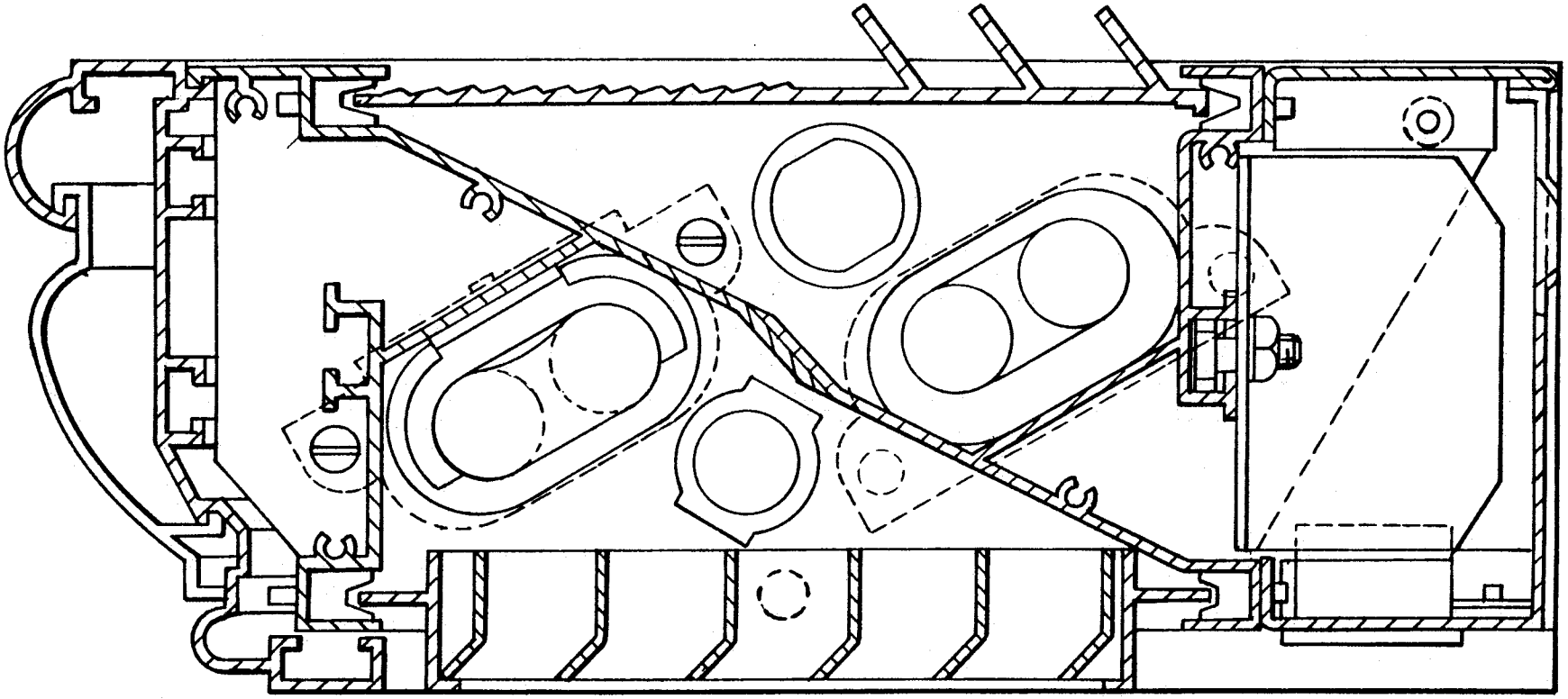
FIG. 6 is a sectional view, like FIG. 5, of another embodiment of the invention using a different bulb and decorative facing insert.

As seen in FIGS. 4 and 5, conventional sockets 110 are mounted in the side walla 100, 102 for supporting elongated fluorescent lamps therein. Alternatively, the bulb may be of the modern U-shaped fluorescent type having a single socket. In that case, the side wall 100 is formed with appropriately shaped openings to mount the proper socket for that type of bulb. (See FIG. 6). Preferably sockets are provided, as illustrated in FIGS. 5 and 6, both above and below the diagonal reflector surface formed by the overlapping stems 74 of reflectors 72. By this arrangement light is reflected upwardly through the open top of the light fixture to provide indirect lighting and is also directed downwardly through the bottom opening to provide direct lighting to the bed.

The construction of the light module of the present invention also provides sufficient room in one of the walls (for example, the side wall 102) for a night light fixture 130 to be mounted therein.

Where fluorescent light fixtures are provided generally a ballast or transformer 120 is required in the light fixture. The construction of the present invention permits the ballast to be mounted directly on lamp module 26 so that it is removed from the peripheral frame with the module. In particular, as seen in FIG. 5, ballast 120 is secured by one or more bolts 122 having polygonal heads 123 trapped in the T-slot 88 of the rear reflector 72. The bolts are engaged in mating holes formed in the mounting flange 125 of ballast 120 and locked to the ballast by lock nuts 127, or the like. The electrical wiring from the opening 30 is connected to the ballast in any convenient manner, preferably by a conventional male and female plug set (not shown). From the ballast electrical wiring passes through the space in the back of the light fixture, adjacent the ballast to sockets 110.

As seen in FIG. 5, lamp module 22 is conveniently inserted and removed from the peripheral frame for support therein. In particular, the lower channel 86 of the front reflector 72, at the front lower end of the module, rests on the upper surface of the channel 44 formed in the front decorative wall of the light fixture. In addition, the extension 90 of the front reflector rests on the internally extending flange 130 of the front decorative frame member. As seen in FIG. 4, the lower ends 140 of the side walls 100, 102 rest on the top surface of the lower channels 44 of the side decorative frame elements. Thus, module 26 is fully supported on three sides in the opening of the peripheral frame.

Figure 7:
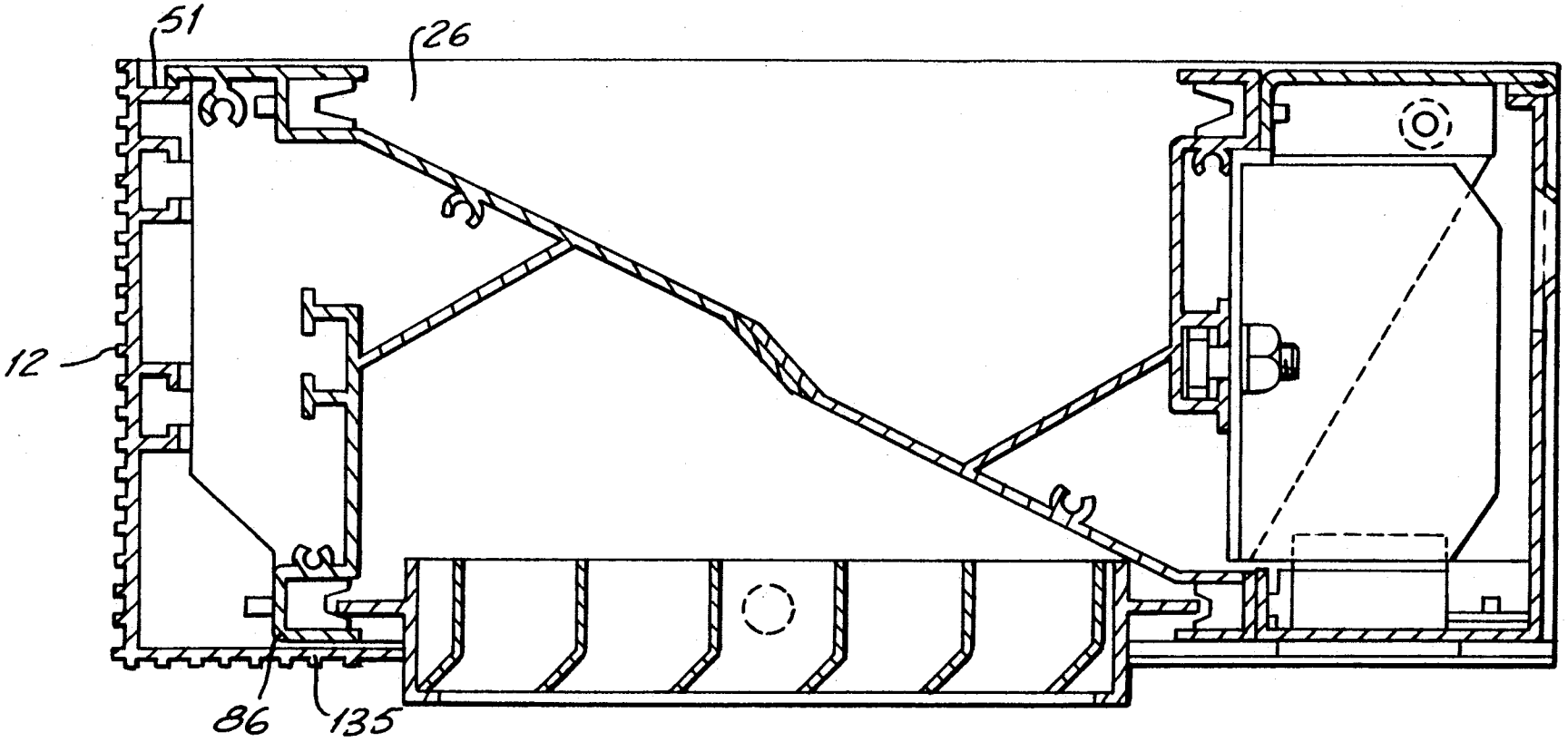
FIG. 7 is a view similar to FIG. 5 illustrating another shape of frame structure

In the embodiment of FIG. 7 it is seen that the module 22 is supported with the front lower channel 86 of the module resting on the rearwardly extending flange 135 of the decorative peripheral frame member 12.

In both embodiments, light module 70 is securely connected to the frame against inadvertent removal by a pair of screws 150, as seen in FIG. 4. These screws extend through openings in the lower portions of the module side walls 100, 102 with the stem 154 of the screws extending through an extension wall 160 of the decorative frame elements that are located adjacent to the side walls of the module. Therefore, by simply engaging or disengaging the two screws 150, the module can be removed from the frame or locked in place. The only other action required is the disconnection of the plug (not shown) between the power supply and the ballast.

The light fixture of the present invention includes an upper light diffuser 180 (FIG. 5) and lower diffuser 190. The upper diffuser is a translucent member having a serrated surface 182 and a plurality of reflector fins 184. The front and rear edges 186, 188 of the diffuser 180 are adapted to be received in the channel 82 of the front reflector and the channel 86 of the rear reflector. Preferably, arcuate spring clips 200 are provided in these channels and secured therein by rivets or the like, as seen in FIG. 5. These spring clips resiliently hold the reflector in place.

In addition, in order to form a neat and decorative closure for the fixture, a closure plate 210 is secured to the bight portion 212 of channel 86 of the rear reflector 72 to overlie the transformer 120 and the upper end of the rear wall 18.

Light diffuser 190 includes a forward end 192 and rear end 194. In the illustrative embodiment the diffuser is a conventional "egg crate" type diffuser which provides direct lighting to the bed below the light fixture. Extensions 192, 194 of diffuser 190 are received in channel 86 of forward reflector 72 and channel 82 of rear reflector 72. They are removably secured in the channels by arcuate spring clips 200, as described above with respect to the diffuser 180.

As illustrated in the drawings, the profiles forming the peripheral frame members have a decorative characteristic. The specific external profile or appearance of these frame members do not form part of the present invention. As noted above, the profile can be a one-piece unit having a serrated appearance, as illustrated in FIG. 7, or, if desired, it may have differently shaped removable snap-in aluminum elements, as illustrated in FIGS. 4, 6 and 8. As seen therein, the removable element 230 has a hook-shaped upper end 232 which engages with a corresponding hook 234 formed in the profile. The lower end 236 of the decorative member 230 will snap-fit by its arrow head-shaped member 238 received against a complementary portion 246 of the profile.

It will be appreciated from the previous description of the invention that a light fixture is provided which is relatively simple in construction and which will permit ready removal and replacement of a light module with a minimum of disturbance to the patient and hospital room. The workman simply needs to remove the diffuser, unscrew two bolts and remove the entire module including the ballast and all of the light bulbs. He then simply drops in a replacement module, containing a properly operating ballast, and new lamps and then rebolts the unit in place. That operation will take a matter of seconds. The module requiring replacement is then removed to an appropriate work area for repair. This is a particularly desirable feature in a hospital environment.

Although illustrative embodiments of the present invention have been described herein with reference to the accompanying drawings, it is to be understood that various changes and modifications may be effected therein by those skilled in the art without departing from the scope or spirit of this invention.

What is claimed is:

1. A light fixture comprising a peripheral frame and a lamp supporting module removably mounted in said frame; said module including means for supporting at least one lamp therein and including reflector means for reflecting light upwardly and downwardly of said peripheral frame, thereby to provide both direct and indirect lighting; said module comprising lateral end walls and said reflector comprises a two-piece reflector unit formed of two substantially identical reflector sections extending between said end walls; said reflector sections each including an elongated reflector surface extending generally diagonally in said frame from the front to rear and from the top to the bottom of the frame; said reflector sections partly overlapping and, together, defining upper and lower reflector surfaces; said means for supporting at least one lamp therein comprising means on at least one of said side walls for supporting at least one lamp above and one lamp below said reflecting surfaces to provide both said direct and indirect lighting.

2. A light fixture as defined in claim 1 wherein said reflector sections have a plurality of elongated open faced channels formed therein with two channels on each section facing each other in the module at upper and lower ends thereof, upper and lower light diffusers for the module and means for releasably mounting said diffusers in said facing channels.

3. A light fixture as defined in claim 2 wherein each or said reflector sections includes one centrally located open channel facing opposite the channels for mounting the diffusers and defining a mounting channel for an electrical power supply unit.

4. A light fixture as defined in claim 3 wherein said peripheral frame includes an internal horizontally extending support surface on which one of the reflector channels and the side walls thereof are supported.

5. A light fixture as defined in claim 4 wherein said peripheral frame is generally rectangular in plan and includes a relatively flat wall member and means for removably mounting that wall member on a room wall.

6. A light fixture as defined in claim 5 wherein said peripheral frame includes a decorative front wall and two decorative side walls; and means for removably mounting said side walls to said flat wall member.

7. A light fixture as defined in claim 6 wherein said decorative side walls of the frame include extension surfaces positioned adjacent and outwardly of the side walls of the module and means for removably securing said side walls of the module and extension surfaces together to secure the module in the frame.

8. A light fixture comprising a peripheral frame having front and back sides defining a central open area and upper and lower portions; and a lamp supporting module removably mounted on said frame within said central open area; said frame having an internal peripherally extending support surface along at least a portion thereof and said module having a mating support surface adapted to rest on the support surface of the frame when the module is placed in said central opening; means for releasably securing said module to the frame; said module including a reflector extending diagonally in the frame between the front and back sides and upper and lower frame portions and means for mounting a pair of lamps on said module above and below the reflector whereby the lighting fixture produces direct light beneath the frame and indirect light above the frame.

9. A light fixture as defined in claim 8 wherein said reflector is formed of two identical reflector sections, each of which is generally Y-shaped and each having a stem and a pair of diverging legs; said sections being positioned with the ends of the stems of the Y-shape being overlapped and the legs opening in opposite directions whereby said stems define a diagonally extending reflector surface in the module.

10. A lighting fixture as defined in claim 9 wherein said module has side walls and said reflector section has C-channels formed therein, and a plurality of screws securing said side walls to the C-channels.

11. A lighting fixture as defined claim 9 wherein the legs of said Y-shaped reflector sections have a plurality of elongated channels formed therein, at least two channels on one reflector section opening towards the rear wall of the frame and two channels on the other reflector section opening towards the front wall and aligned with the channels of the other reflector section; an upper and lower light diffuser and means for removably mounting said diffusers in said channels.

12. A lighting fixture as defined in claim 11 wherein one of said legs of each reflector section includes an oppositely opening T-shaped channel means for mounting an electrical power supply unit thereto.

13. A light fixture as defined in claim 8 wherein said peripheral frame is generally rectangular in plan and includes a pair of side walls; said front and side walls having decorative external faces and means formed in said side walls for removably mounting said side walls to said back side.

14. A light fixture as defined in claim 13 wherein said back side of the peripheral frame includes means for removably mounting the frame on a room wall.

15. A light fixture as defined in claim 14 wherein said decorative side walls of the frame include extension surfaces positioned adjacent and outwardly of the side walls of the module and means for removably securing said side walls of the module and extension surfaces together to secure the module in the frame.

16. A light fixture as defined in claim 14 wherein said decorative front and side walls of the peripheral frame are identical in cross-section and include inwardly opening T-slots; the T-slots of the side walls defining the means for mounting the side walls to the back wall.

17. A reflector element for a light fixture comprising a pair of generally Y-shaped reflectors each having a stem and a pair of diverging legs; a leg of each reflecting defining an elongated open channel opening towards the stem thereof; one of said legs in each reflector also having an elongated T-slot formed therein opening in a direction opposite the open channel to provide a mounting support, whereby said reflectors may be positioned in inverted mirror image to each other to define a reflector module having an elongated reflector surface defined by the stems and legs thereof.

18. A reflector as defined in claim 17 wherein said stem on each reflector is aligned with one of the legs of that reflector, whereby said reflectors are positioned in inverted mirror image to each other they produce a diagonal reflector surface.

* * * * *